US005256044A

United States Patent [19]

Nieter et al.

[11] Patent Number: 5,256,044

[45] Date of Patent: Oct. 26, 1993

[54] SCROLL COMPRESSOR WITH IMPROVED AXIAL COMPLIANCE

[75] Inventors: Jeffrey J. Nieter, Coventry; Raymond L. DeBlois, Tolland; Anthony J. Marchese, Wethersfield, all of Conn.; Thomas R. Barito, E. Syracuse, N.Y.

[73] Assignee: Carrier Corporation, Farmington, Conn.

[21] Appl. No.: 44,905

[22] Filed: Apr. 8, 1993

Related U.S. Application Data

[63] Continuation of Ser. No. 763,691, Sep. 23, 1991, abandoned.

[51] Int. Cl.[5] ..... F04C 18/04

[52] U.S. Cl. ..... 418/55.5; 418/57

[58] Field of Search ..... 418/55.5, 57

[56] References Cited

U.S. PATENT DOCUMENTS

| | | | |
|---|---|---|---|
| 4,384,831 | 5/1983 | Ikegawa et al. | 418/55.5 |
| 4,557,675 | 12/1985 | Murayama et al. | 418/55.5 |
| 4,600,369 | 7/1986 | Blain | 418/55.5 |
| 4,645,437 | 2/1987 | Sakashita et al. | 418/55.5 |
| 4,696,630 | 9/1987 | Sakata et al. | 418/55.5 |
| 4,767,293 | 8/1988 | Caillat et al. | 418/55.5 |
| 4,861,245 | 8/1989 | Tojo et al. | 418/55.5 |
| 4,938,669 | 7/1990 | Fraser, Jr. et al. | 418/55.5 |
| 4,992,032 | 2/1991 | Barito et al. | 418/55.4 |
| 4,993,928 | 2/1991 | Fraser, Jr. | 418/55.4 |
| 5,085,565 | 2/1992 | Barito | 418/55.5 |

FOREIGN PATENT DOCUMENTS

| | | | |
|---|---|---|---|
| 59-108893 | 6/1984 | Japan | 418/55.5 |
| 63-106388 | 5/1988 | Japan | 418/57 |

OTHER PUBLICATIONS

*Dynamic Axial Compliance to Reduce Friction Between Scroll Elements*, Nieter et al., 1992 International Compressor Engineering Conference at Purdue, vol. III, Jul. 1992.

*Primary Examiner*—John J. Vrablik

*Attorney, Agent, or Firm*—William W. Habelt

[57] ABSTRACT

Improved axial compliance in a scroll compressor 10 between a fixed scroll 11 and an orbiting scroll 13 is achieved by providing at least one dynamic back pressure chamber 25 disposed behind the orbiting scroll 13. A pressurized fluid is bled from a selected one of compression pockets 19 through a port 21 formed in the orbiting scroll 13 into the dynamic back chamber 25 to provide varying on sub-cycle basis back pressure to reduce friction between the fixed and orbiting scrolls. A static back pressure chamber 27, also disposed behind the orbiting scroll 13, may be provided into which pressurized fluid is bled from a selected one of the compression pockets 19 to provide an additional back pressure on the scroll 13 which is substantially constant over the cycle.

6 Claims, 4 Drawing Sheets

INSTANTANEOUS OVERTURNING MOMENT: UNDER–PRESSURE CONDITION

INSTANTANEOUS OVERTURNING MOMENT: OVER–PRESSURE CONDITION

AXIAL COMPLIANCE FORCE: UNDER-PRESSURE CONDITION

AXIAL COMPLIANCE FORCE: OVER-PRESSURE CONDITION

SCROLL COMPRESSOR WITH IMPROVED AXIAL COMPLIANCE

This application is a continuation of application Ser. No. 07/763,691 filed Sep. 23, 1991, now abandoned.

TECHNICAL FIELD

This invention relates to scroll compressors, and more particularly to improving axial compliance between scroll elements thereby achieving higher efficiency in scroll compressors.

BACKGROUND OF INVENTION

Scroll compressors have a wide range of applications where low to moderate compression ratios are desired, especially in the air conditioning and heat pump industries. This acceptance is attributed to high efficiency, fewer parts, and less noise and vibration when compared with competing compressors. A conventional scroll compressor includes a motor, which drives a shaft with an eccentric crank, causing orbiting motion of an orbiting scroll element. The orbiting scroll element has a scroll or spiral shaped protruding wrap, which interacts with a similarly shaped protruding wrap on a mating fixed element. Compression is achieved when the meshing coaction between the two protruding wraps shifts the gaseous fluid radially inward and simultaneously reduces the volume of the fluid.

However, internal leakage of pressurized fluid reduces the efficiency of scroll compressors. There are two types of leakage associated with scroll compressors, one is flank leakage, and the other is tip leakage. In both cases, the fluid in higher pressure pockets escapes through the gaps into lower pressure pockets. Flank leakage occurs when fluid from a pocket formed between the two protruding meshing wraps escapes at the flank surfaces where they come into contact with each other. Tip leakage occurs when fluid escapes between the end surface of the protruding wrap of each element and the base of the other element as they come into contact. Tip leakage is the more severe of the two because the effective total leakage path width for tip leakage is typically several times larger than that for flank leakage. Further, the compression process produces large axial loads that push the orbiting scroll element axially away from the fixed scroll element, thereby increasing the tip leakage. In addition to the axial forces driving orbiting scroll element away from the fixed scroll, there is also an overturning moment attempting to tip the orbiting scroll element out of the plane with the fixed scroll element.

This overturning moment results from the couple established between the non-axial component of the pressure forces generated within the compression pockets during the compression process and the reaction force thereof established between the shaft of the orbiting scroll element and its support bearings.

Since close-tolerance manufacturing techniques are not adequate to prevent the loss of pressure due to tip leakage, other methods have been developed. One approach is to utilize various types of tip seals, as described in U.S. Pat. Nos. 4,395,205; 4,411,605; 4,415,317; 4,416,597. The end surface of the protruding wrap of either scroll element is equipped with tip sealing means which reduce the tip leakage. Although this method is effective for sealing, it requires complicated manufacturing, increases friction, and raises costs.

Another approach to decrease tip leakage is to apply compensating back pressure to force mating elements together. Higher pressure fluid is purposely bled from the compression chamber through a vent port into a back chamber, which is typically a single, relatively large chamber located behind the orbiting scroll. This provides a body of pressurized fluid which pushes the orbiting element against the fixed element and thus, reduces the gap between the tips of the protruding scrolls and the bases of the elements. Reducing the gap minimizes the leakage of fluid, resulting in the increase of pressure in the compression chamber.

For example, U.S. Pat. Nos. 4,384,831; 4,600,369; 4,645,437; 4,696,630; and 4,861,245, each disclose a scroll compressor having such a back chamber. Commonly-assigned U.S. Pat. Nos. 4,992,032 and 4,993,928 also disclose scroll compressors using the back pressuring technique. As disclosed therein, rather than a single back chamber, two sealed pressure chambers, one at intermediate pressure and another at discharge pressure, are disposed behind the orbiting scroll element and are designed to counteract the gas compression forces within the compression chamber and to bias the orbiting scroll element toward the fixed scroll element. However, the prior art back pressuring technique is designed to overcome the highest overturning moment experienced during the orbiting cycle and leads to excessive thrust force over the remainder of the cycle. The large thrust force causes excessive friction between the two mating parts and results in reduced efficiency of the scroll compressors.

Additionally, U.S. Pat. No. 4,557,675 discloses a method of adjusting pressure in the back chamber by positioning pressure-equalizing ports so that the pressure vented into the back chamber varies with changes in operating conditions. However, the back pressure remains relatively constant during any given steady-state condition, thus, the change in pressure, as the operating conditions vary, is intended to overcome the highest overturning moment and axial force, resulting in excessive thrust force during the remainder of the cycle and causing excessive friction, thereby reducing the efficiency of the scroll compressor.

DISCLOSURE OF INVENTION

An object of the invention is to increase the efficiency of scroll compressors by reducing frictional forces between the scrolls.

According to the present invention, pressurized fluid is vented from the compression chamber into at least one dynamic back chamber through a port in the scroll element, so that the back pressure will vary on a sub-cycle basis. A dynamic back chamber, characterized by a relatively small volume of the chamber and a large flow area port for supplying pressure fluid thereto, is located behind the orbiting element. In accordance with this invention, an efficient means of counteracting the overturning moment without producing excessive friction forces may be achieved by varying the back pressure on a sub-cycle basis.

These and other objects, features, and advantages of the present invention will become more apparent in light of the detailed description of a best mode embodiment thereof, as illustrated in the accompanying drawing.

BEST MODE FOR CARRYING OUT THE INVENTION

Figure 1:
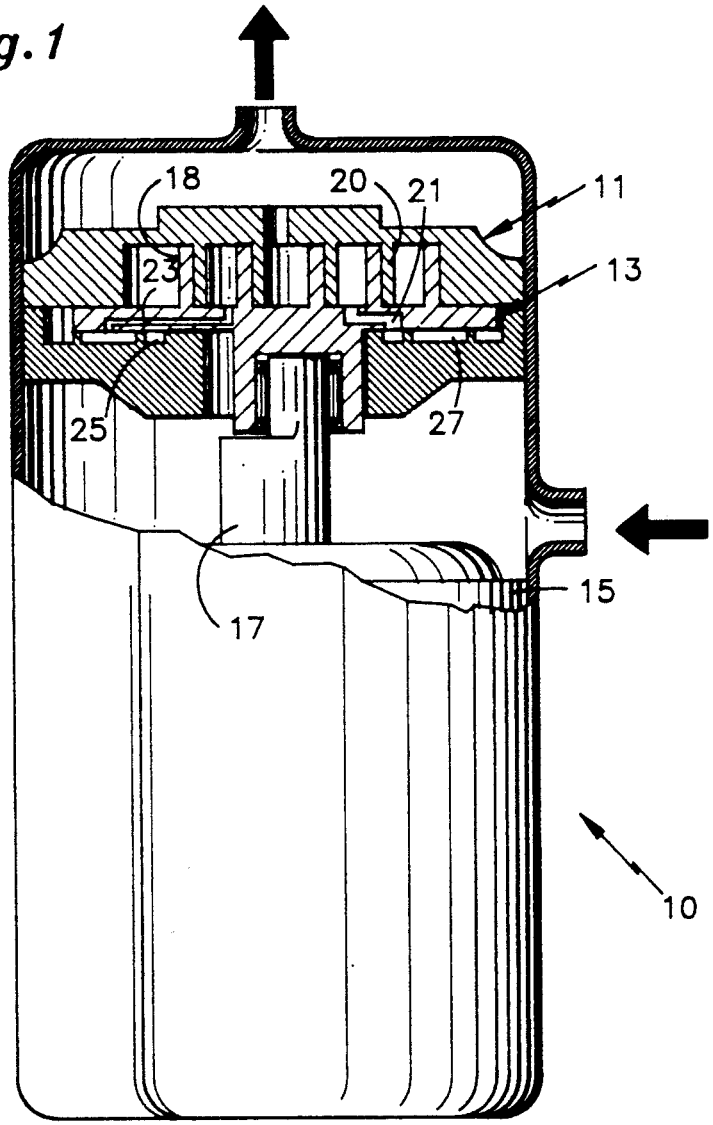
FIG. 1 is a diagrammatic, side elevation view of a scroll compressor in accordance with the present invention.
Figure 2:
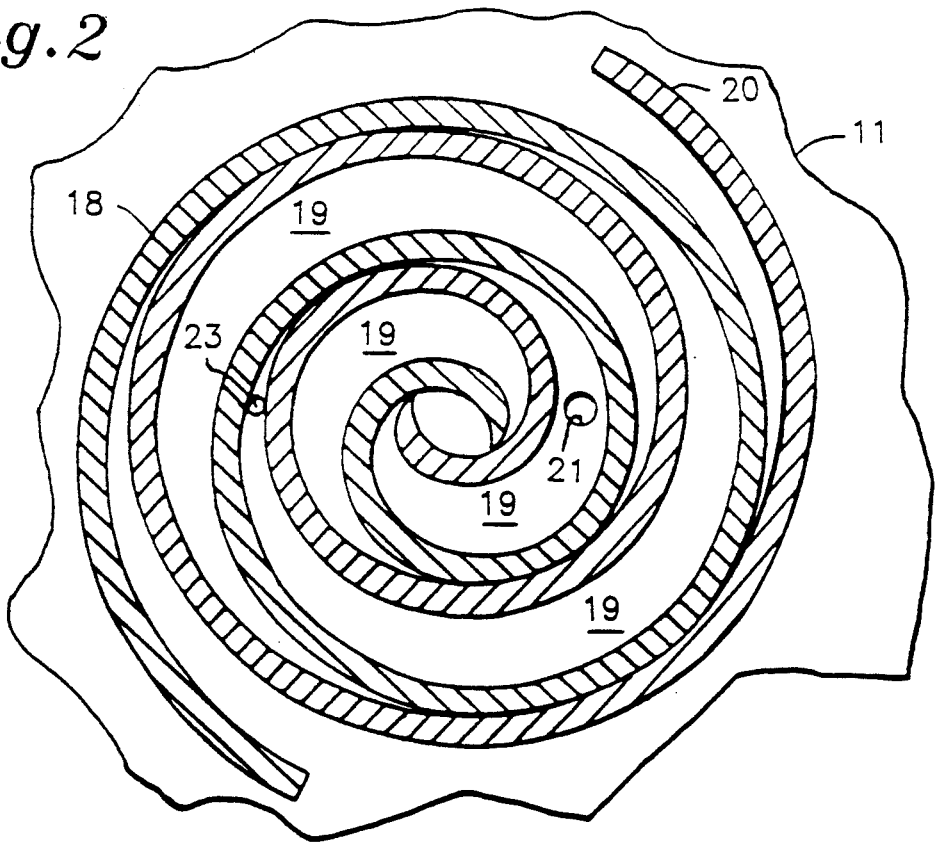
FIG. 2 is a sectioned plan view illustrating the meshing of the protruding scroll wraps of the scroll compressor shown in FIG. 1 so as to form compression pockets therebetween.
Figure 3:
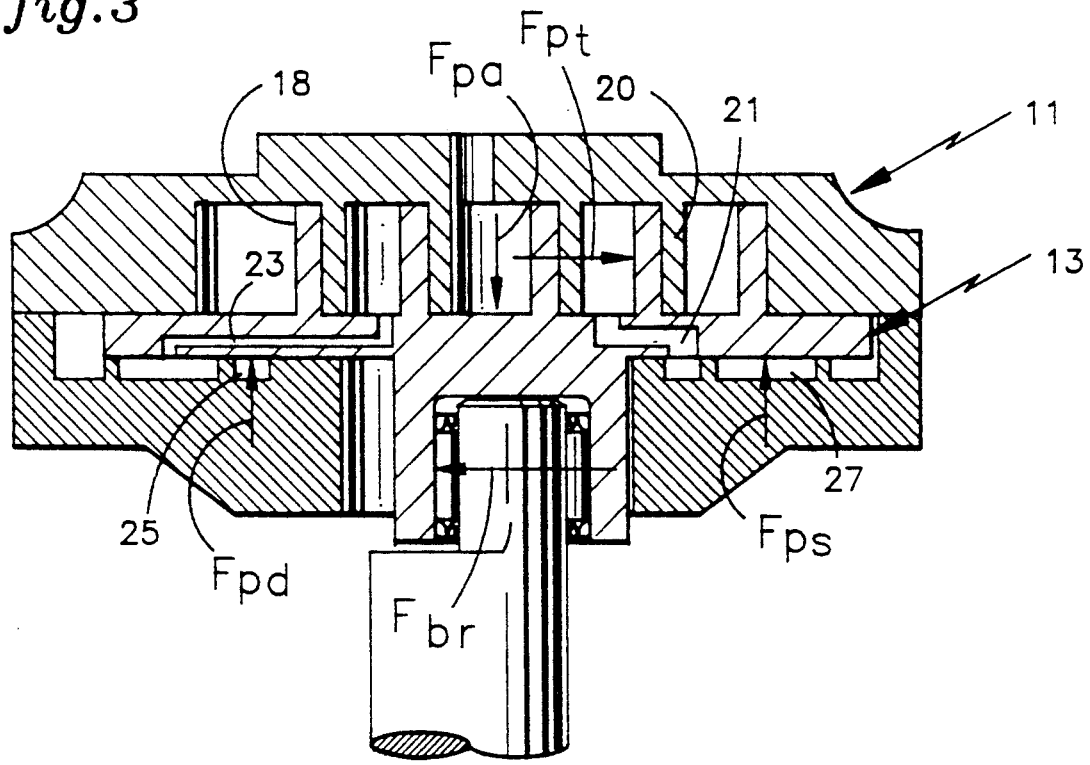
FIG. 3 is an enlarged, partial, sectioned view of a portion of the scroll compressor of FIG. 1.

Referring now to FIGS. 1-3, a scroll compressor 10 includes a fixed scroll 11 which is engaged with an orbiting scroll 13. The orbiting scroll 13 is driven by a shaft 17 which is driven by motor 15 in orbital movement relative to the fixed scroll 11. Fluid compression is achieved as scroll wraps 18, 20 protruding from the orbiting scroll 13 and the fixed scroll 11, respectively, mesh to form a plurality of compression pockets 19 therebetween to trap volumes of fluid. This orbital action displaces the pockets of trapped fluid spirally inward while simultaneously reducing fluid volume of the pockets thereby compressing the fluid trapped therein.

During the compression process, pressure forces having axial and non-axial components are generated within the compression pockets. Referring to FIG. 3, the resultant axial force, $F_{pa}$, tends to push the orbiting scroll 13 away from the fixed scroll 11 and the resultant tangential force, $F_{pt}$, forms a couple with the reaction force, $F_{br}$, thereto established between the hub of the orbiting scroll 13 and the support bearings 14 on shaft 17, which couple produces an overturning moment, $M_o$, which tends to tip the orbiting scroll 13 relative to the fixed scroll 11. Due to the pressures created in the static and dynamic backpressure chambers, an axially directed resultant backpressure compliance force, $F_{pr}$, is produced which acts substantially along the central axis of the drive shaft 17 and comprises the sum of the axial components of the distributed pressure forces, $F_{ps}$ and $F_{pd}$, produced in the static and dynamic backpressure chambers, respectively, and acting upon the back of the orbiting scroll to push the orbiting scroll 13 against the fixed scroll 11. This resultant back pressure force, although acting substantially along the central axis of the shaft 17, does not act through the center of mass of the orbiting scroll 13 mounted to the eccentric crank portion 17A of the shaft 17. There is also established a net reaction force, $F_{nr}$, resulting from the net interaction of all axial pressure forces acting on the orbiting scroll, that is the axially directed resultant backpressure compliance force, $F_{pr}$, and the opposed axially directed pressure force, $F_{pa}$,. This net reaction force acts as a thrust force on the orbiting scroll at a radial distance from the center of mass of the orbiting scroll, thereby creating a counteracting moment, $M_c$, which acts in opposition to the overturning moment, $M_o$.

As best seen in FIG. 3, a flow of pressurized fluid is bled through the ports 21, 23 into back chambers 25, 27, respectively. The fluid in these chambers produces back pressure which pushes the orbiting scroll 13 towards the fixed scroll 11 in order to reduce tip leakage and counteract overturning moment. However, the back pressure produced is not constant over the entire cycle. Instead, it varies during the cycle to follow the fluctuations in the overturning moment, which acts on the orbiting scroll 13 and causes it to tip with respect to the fixed scroll 11. Thus, the back pressure created is just enough to counteract the overturning moment. When the overturning moment is high, greater back pressure is available to hold the orbiting scroll in place to avoid leakage. When the overturning moment is low, the back pressure is also less and thus, does not cause excessive friction loss. This effect is attained by providing at least one dynamic chamber in which the pressure fluctuates in proportion to the overturning moment.

In the embodiment shown, there are two ports 21, 23 and two corresponding chambers 25, 27. Port 23 supplies pressurized fluid into the static chamber 27. Port 21 supplies pressurized fluid into dynamic chamber 25. The distinction between the two is that static chamber has a relatively constant fluid pressure throughout the entire cycle, while the dynamic chamber has widely varying fluid pressure during the cycle. The static port/chamber combination has a small port diameter and a large chamber volume. The dimensions are selected in such a way as to produce sufficient damping so that pressure is nearly constant throughout the cycle.

The variation of pressure on a sub-cycle basis in the dynamic chamber is attained by properly sizing the port diameter and chamber volume parameters relative to each other. The dynamic port/chamber pair has a large diameter port 21 and small chamber volume 25. The dimensions are selected in such a way as to produce very little damping so that the pressure in the dynamic chamber follows the compression process. This achieves the pressure variation on a sub-cycle basis.

It has been found that in order to maintain substantially constant pressure in the static chamber, the ratio of port diameter to the cubed root of chamber volume should be relatively small. In order to provide widely varying pressure in the dynamic chamber the ratio should be relatively large. For example, when a compressor designed with a static chamber having the ratio of 0.05 and dynamic chamber having a ratio of 0.22 was tested, it exhibits a roughly 45% reduction in net axial force.

Figure 4A:
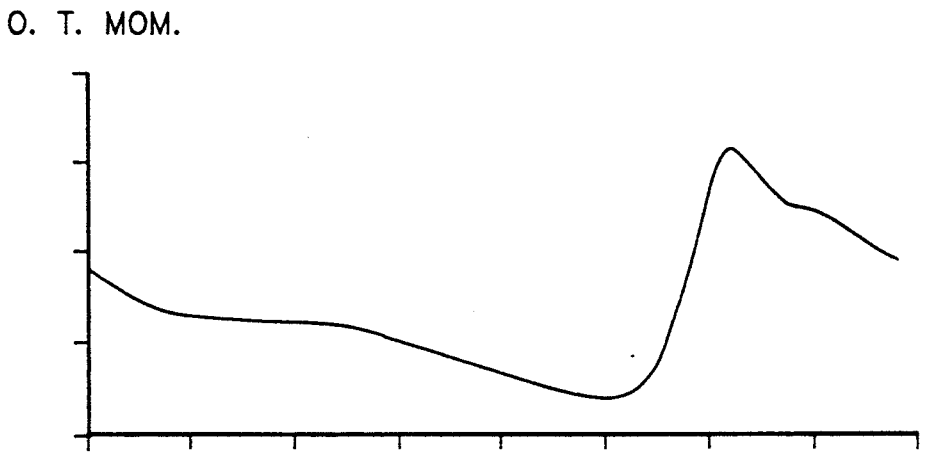
FIGS. 4*a* and 4*b* are exemplary graphs of overturning moment versus crank angle for two different operating envelope conditions, underpressure and overpressure, respectively.
Figure 4B:
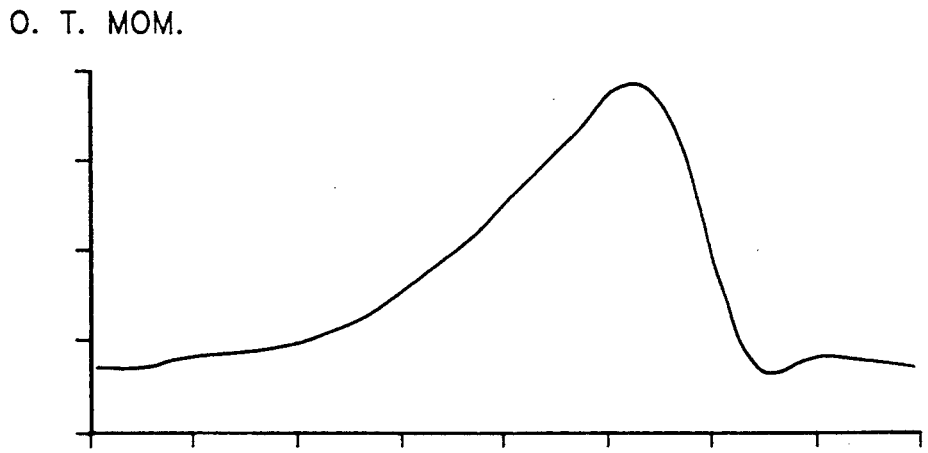
Figure 5A:
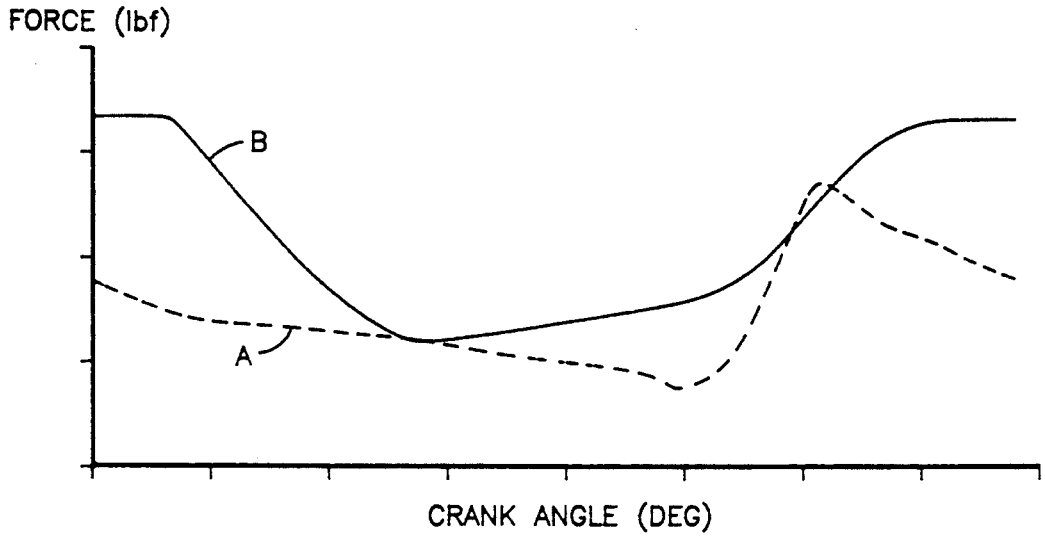
FIGS. 5*a* and 5*b* are exemplary graphs of the minimum compliance forces required to counter the overturning moments to FIGS. 4*a* 4*b*, respectively, and actual backpressure compliance forces produced in accordance with the present invention versus crank angle.
Figure 5B:
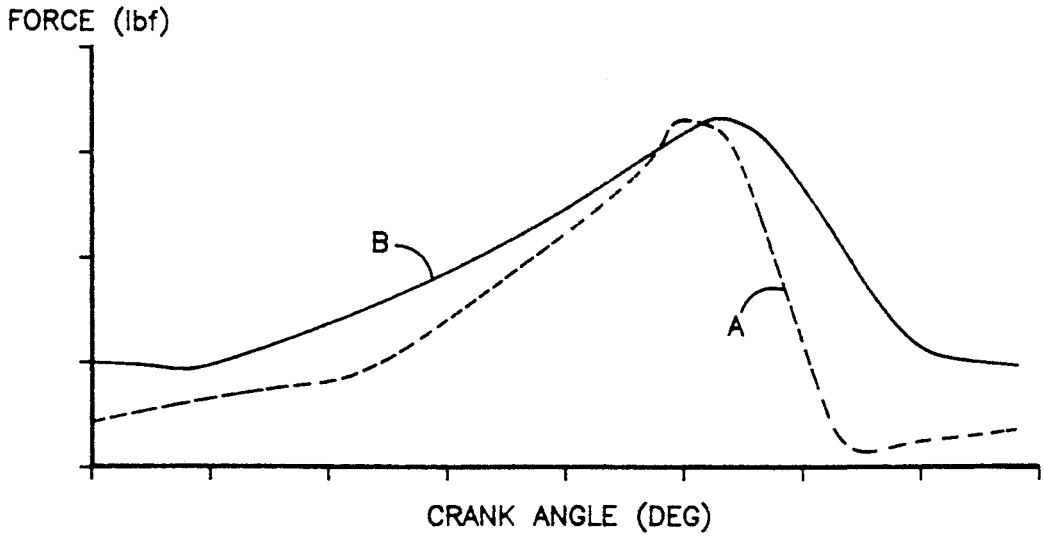

In FIGS. 4*a* and 4*b*, the variation of overturning moment versus crank angle is illustrated over one orbiting cycle for two different operating conditions, underpressure and over-pressure, respectively. The crank angle is commonly known in the art to refer to the circumferential displacement, measured in degrees, of a radial reference line on the orbiting scroll from a radial reference line on the fixed scroll. The overturning moment produced by the couple formed by the resultant tangential pressure force and the bearing reaction force various substantially under both operating conditions. Referring now to FIGS. 5*a* and 5*b*, curve A represents the minimum compliance force required to be exerted axially against the back side of the orbiting scroll to overcome the overturning moment illustrated in FIGS. 4*a* and 4*b*, respectively, at each crank angle over one orbiting cycle, that is to prevent the overturning moment from tipping the orbiting scroll relative to the fixed scroll. Curve B represents the backpressure compliance force exerted axially against the back side of the orbiting scroll of a scroll compressor embodying a static backpressure and a dynamic backpressure for these two operating conditions. This backpressure compliance force is the sum of the axially directed pressure forces, $F_{pg}$ and $F_{pd}$, produced in the static and dynamic backpressure chambers, respectively. As the backpressure in the static chamber 27 remains substantially constant over an orbiting cycle and the backpressure in the dynamic chamber 25 varies in proportion to the variation of the pressure within the compression pockets 19 over an orbiting cycle, the backpressure compliance force represented by curve B closely approximates the minimum required backpressure force necessary to overcome the overturning moment at each crank angle over an orbiting cycle, thereby counteracting the overturning moment without producing excessive friction forces and a consequent reduction in operating efficiency.

Although the embodiment illustrated has one dynamic and one static chamber/port combination, other combinations are possible. This invention encompasses any number of dynamic chamber/port combinations that is one or more, with or without any number of static chambers. Since the total back pressure force on the scroll is the sum of the forces generated by the constant pressure in the static chamber and the varying pressure in the dynamic chamber, the total back pressure varies over the orbiting cycle instead of remaining constant, as in the prior art.

Also, one port may lead to more than one chamber and vice-versa, more than one port may lead into one chamber, as long as the appropriate ratios of effective port diameter/cubed root of effective chamber volume are maintained. Another variation that may yield substantially similar results is that back pressure may be applied to the fixed scroll, as opposed to the orbiting scroll, wherein the fixed scroll is able to move axially. Although the exact position of ports is not critical to this invention and may depend on characteristics of each compressor, the port location selection should utilize the pressure variation inside the compression chamber in order to produce sufficient pressure in the back chamber.

Although the invention has been shown and described with respect to a best mode embodiment thereof, it should be understood by those skilled in the art that the foregoing and various other changes, omissions, and additions in the form and detail thereof may be made therein without departing from the spirit and scope of the invention.

We claim:

1. A scroll compressor for compressing a fluid, comprising:

a first scroll means having a floor portion and a spiral wrap portion extending perpendicularly from said floor portion of said first scroll mean;

a second scroll means having a floor portion and a spiral wrap portion extending perpendicularly from said floor portion of said second scroll means, said spiral wrap of said second scroll means being similarly shaped to said spiral wrap of said first scroll means, said second scroll means positioned relative to said first scroll means such that said spiral wraps mesh with each other to form compression pockets therebetween;

shaft means for moving said first scroll means in an orbiting path relative to said second scroll means so that fluid compression is achieved in said compression pockets the fluid compression generating a resultant pressure force within said compression pockets having an axial component and a non-axial component;

bearing means disposed about said shaft means for supporting said shaft means whereby a reaction force is generated counteracting the non-axial component of the pressure force in said compression pockets, the reaction force and the non-axial component of the pressure force generating an overturning moment acting upon said first scroll means, said overturning moment having a magnitude which varies over an orbiting cycle; said scroll compressor characterized by;

a dynamic backpressure chamber disposed behind at least one of said first scroll means and said second scroll means, said dynamic backpressure chamber having a first volume; and means for venting fluid into said dynamic backpressure chamber from a first selected one of said compression pockets at a selected location at which the fluid has a pressure which varies substantially over an orbiting cycle of said first scroll means thereby establishing a dynamic pressure therein which substantially varies over an orbiting cycle of said first scroll means in proportion to the overturning moment generated during the compression process thereby preventing the overturning moment, from tipping said first scroll means relative to said second scroll means, said means for venting having a first effective flow diameter with a ratio of said first effective flow diameter to the cube root of said first volume being on the order of at least about 0.2.

2. The apparatus of claim 1, further comprising:

a static back pressure chamber disposed behind at least one of said first scroll means and said second scroll means, said static back chamber having a second volume; and means for venting fluid from a second selected one of said compression pockets into said static back chamber to establish a static pressure therein which remains relatively constant over an orbiting cycle of said first scroll means.

3. The apparatus of claim 2, wherein:

said means for venting fluid from the first selected compression pocket into said dynamic back chamber comprises a first fluid passageway through said floor portion of said at least one of said first scroll means and said second scroll means, said first fluid passageway having a first end opening to the first selected compression pocket and a second end port opening to said dynamic back chamber, said first fluid passageway having a first effective flow diameter strongly influenced by a minimum first diameter; and said means for venting fluid from the second selected compression chamber into said static back pocket comprises a second fluid passageway through said floor portion of said at least one of said first scroll means and said second scroll means, said second fluid passageway having a first end opening to the second selected compression pocket and a second end port opening to said static back chamber, said second fluid passageway having a second effective flow diameter strongly influenced by a minimum second diameter.

4. The apparatus of claim 3, wherein:

a ratio of the second effective flow diameter to the cube root of said second volume of said static back pressure chamber is on the order of about 0.05.

5. A scroll compressor for compressing a fluid, comprising:

a first scroll means having a floor portion and a spiral wrap portion extending perpendicularly from said floor portion of said first scroll means;

a second scroll means having a floor portion and a spiral wrap portion extending perpendicularly from said floor portion of said second scroll means, said spiral wrap of said second scroll means being similarly shaped to said spiral wrap of said first scroll means, said second scroll means positioned relative to said first scroll means such that said spiral wraps mesh with each other to form compression pockets therebetween;

shaft means for moving said first scroll means in an orbiting path relative to said second scroll means so that fluid compression is achieved in said compression pockets the fluid compression generating a resultant pressure force within said compression pockets having an axial component and a non-axial component;

bearing means disposed about said shaft means for supporting said shaft means whereby a reaction force is generated counteracting the non-axial component of the pressure force in said compression pockets, the reaction force and the non-axial component of the pressure force generating an overturning moment acting upon said first scroll means, said overturning moment having a magnitude which varies over an orbiting cycle; said scroll compressor characterized by;

a first backpressure chamber disposed behind at least one of said first scroll means and said second scroll means, said first backpressure chamber having a first volume;

a second backpressure chamber disposed behind at least one of said first scroll means and said second scroll means, said second backpressure chamber having a second volume;

a first fluid passageway means for venting fluid from a first selected one of said compression pockets into said first backpressure chamber, said first selected one of said compression pockets having a pressure which varies substantially over an orbiting cycle, said first fluid passageway means having a minimum flow diameter and a first effective flow diameter strongly influenced by the minimum flow diameter thereof; and a second fluid passageway means for venting fluid from a second selected one of said compression pockets into said second backpressure chamber, said second fluid passageway means having a minimum flow diameter and a second effective flow diameter strongly influenced by the minimum flow diameter thereof, a ratio of the first effective flow-diameter of said first fluid passageway means to the cubic root of the first volume of said first backpressure chamber being relatively large compared to a ratio of the second effective flow diameter of said second fluid passageway means to the cubic root of the second volume of said second backpressure chamber, thereby establishing a dynamic pressure within said first backpressure chamber which substantially varies over an orbiting cycle of said first scroll means in proportion to the overturning moment generated during the compression process thereby preventing the overturning moment from tipping said first scroll means relative to said second scroll means and thereby establishing a static pressure within said second backpressure chamber which remains relatively constant over an orbiting cycle of said first scroll means.

6. A scroll compressor as recited in claim 5, further characterized in that the ratio of the first effective flow diameter of said first fluid passageway means to the cubic root of the first volume of said first back pressure chamber is on the order of about 0.2 and the ratio of the second effective flow diameter of said second fluid passageway means to the cubic root of the second volume of said second back pressure chamber is on the order of about 0.05.

* * * * *